US009883705B1

(12) United States Patent
Do

(10) Patent No.: US 9,883,705 B1
(45) Date of Patent: Feb. 6, 2018

(54) BABY GARMENT WITH MULTIPLE INTERCHANGEABLE THEMED KNEE PADS

(71) Applicant: Thuan Do, Orlando, FL (US)

(72) Inventor: Thuan Do, Orlando, FL (US)

( * ) Notice: Subject to any disclaimer, the term of this patent is extended or adjusted under 35 U.S.C. 154(b) by 252 days.

(21) Appl. No.: 14/969,404

(22) Filed: Dec. 15, 2015

(51) Int. Cl.
*A41D 13/06* (2006.01)
*A41D 13/05* (2006.01)
*A41B 13/04* (2006.01)

(52) U.S. Cl.
CPC ..... *A41D 13/065* (2013.01); *A41B 13/04* (2013.01); *A41D 13/0562* (2013.01); *A41B 2400/80* (2013.01)

(58) Field of Classification Search
CPC ..... A41D 13/065; A41D 1/06; A41D 13/02
See application file for complete search history.

(56) References Cited

U.S. PATENT DOCUMENTS 2,561,872 A * 7/1951 Krinick ..... A41D 13/065 2/24
4,484,360 A * 11/1984 Leighton ..... A63B 71/1225 2/22
4,561,123 A * 12/1985 Hull ..... A41D 13/065 2/16
4,831,666 A * 5/1989 Denman ..... A41D 13/0575 2/23
4,879,765 A * 11/1989 Bailie ..... A41B 13/00 2/24
5,592,689 A * 1/1997 Matthews ..... A41B 13/00 2/23
5,732,412 A * 3/1998 Holden ..... A41D 13/0562 2/23
5,978,962 A * 11/1999 Hamowy ..... A41D 13/0568 2/16
7,089,598 B2 8/2006 Sallas
7,216,370 B1 * 5/2007 Warner ..... A41D 13/0575 2/23
7,219,372 B2 * 5/2007 Frieler ..... A41D 13/0562 2/23
7,380,283 B1 * 6/2008 Dumont ..... A41D 13/0562 2/23
D590,998 S 4/2009 Feeley
7,891,018 B2 2/2011 Atkinson
D686,390 S 7/2013 Downs
2004/0221353 A1 * 11/2004 Kennard ..... A41D 13/065 2/24

(Continued)

FOREIGN PATENT DOCUMENTS

WO WO2012009233 A1 1/2012

*Primary Examiner* — Tejash Patel
(74) *Attorney, Agent, or Firm* — Kyle A. Fletcher, Esq.

(57) ABSTRACT

The baby garment with multiple interchangeable themed knee pads is adapted for use with infants. Specifically, the baby garment with multiple interchangeable themed knee pads is a pair of pants intended for infants wherein non-skid knee pads are attached to the pants such that the knee pads will rest between the knee of the infant and the surface upon which the infant is crawling. The knee pads of the baby garment with multiple interchangeable themed knee pads are removable and replaceable. A plurality of knee pads are provided for esthetics purposes. The baby garment with multiple interchangeable themed knee pads comprises pants, a plurality of hook and loop fasteners, and a plurality of knee pads.

11 Claims, 4 Drawing Sheets

(56) References Cited

U.S. PATENT DOCUMENTS

| | | | |
|---|---|---|---|
| 2006/0117451 | A1 | 6/2006 | Sciortino |
| 2008/0047043 | A1 | 2/2008 | Flores-Garvey |
| 2012/0260391 | A1 | 10/2012 | Davtyan |
| 2014/0020160 | A1 | 1/2014 | Ford |

* cited by examiner

BABY GARMENT WITH MULTIPLE INTERCHANGEABLE THEMED KNEE PADS

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of protective garments, more specifically, a knee pad for infants.

SUMMARY OF INVENTION

The baby garment with multiple interchangeable themed knee pads is adapted for use with infants. Specifically, the baby garment with multiple interchangeable themed knee pads is a pair of pants intended for infants wherein non-skid knee pads are attached to the pants such that the knee pads will rest between the knee of the infant and the surface upon which the infant is crawling. The knee pads of the baby garment with multiple interchangeable themed knee pads are removable and replaceable. A plurality of knee pads are provided for esthetics purposes.

These together with additional objects, features and advantages of the baby garment with multiple interchangeable themed knee pads will be readily apparent to those of ordinary skill in the art upon reading the following detailed description of the presently preferred, but nonetheless illustrative, embodiments when taken in conjunction with the accompanying drawings.

In this respect, before explaining the current embodiments of the baby garment with multiple interchangeable themed knee pads in detail, it is to be understood that the baby garment with multiple interchangeable themed knee pads is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the baby garment with multiple interchangeable themed knee pads.

It is therefore important that the claims be regarded as including such equivalent construction insofar as they do not depart from the spirit and scope of the baby garment with multiple interchangeable themed knee pads. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
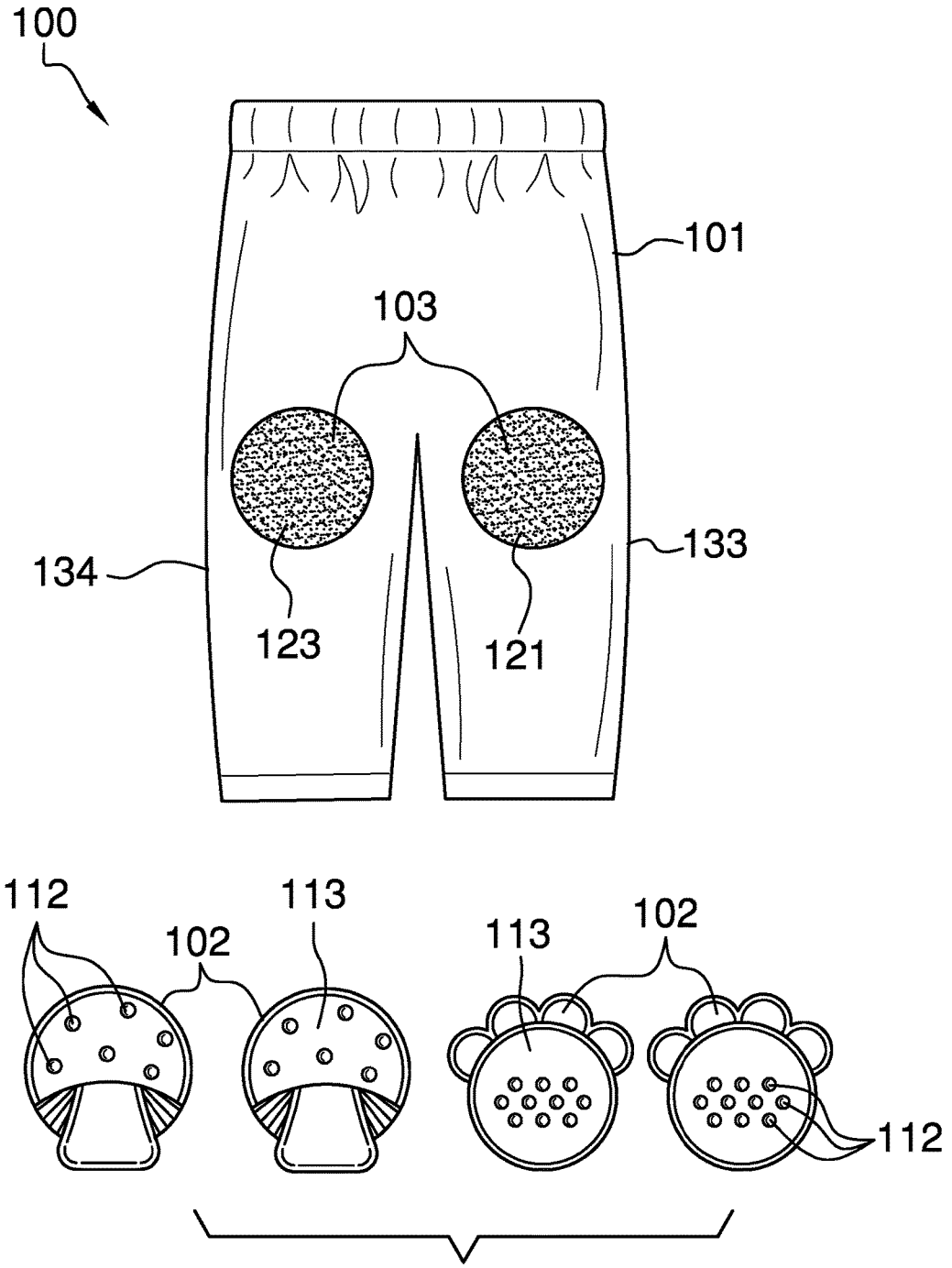
FIG. 1 is a front view of an embodiment of the disclosure.
Figure 2:
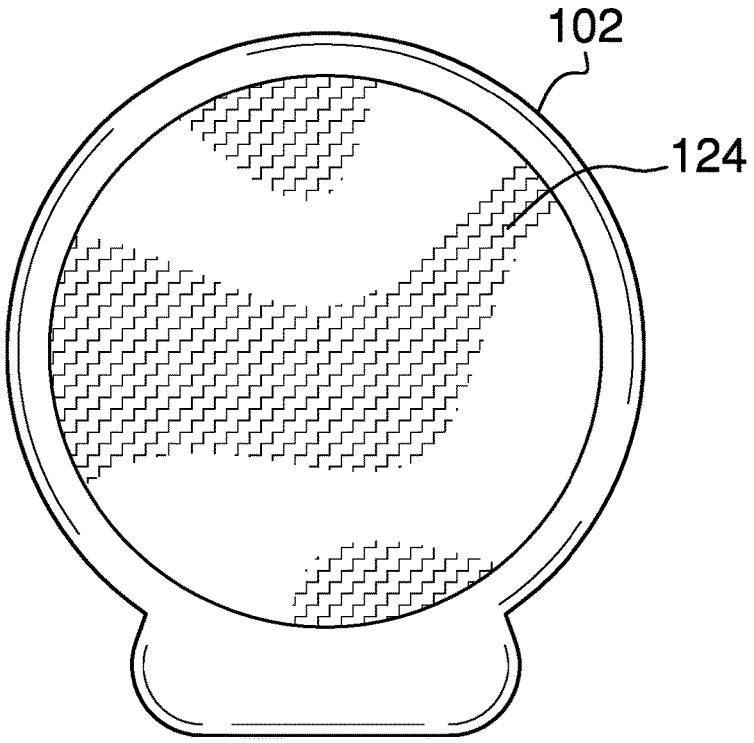
FIG. 2 is a rear detail view of an embodiment of the disclosure.
Figure 4:
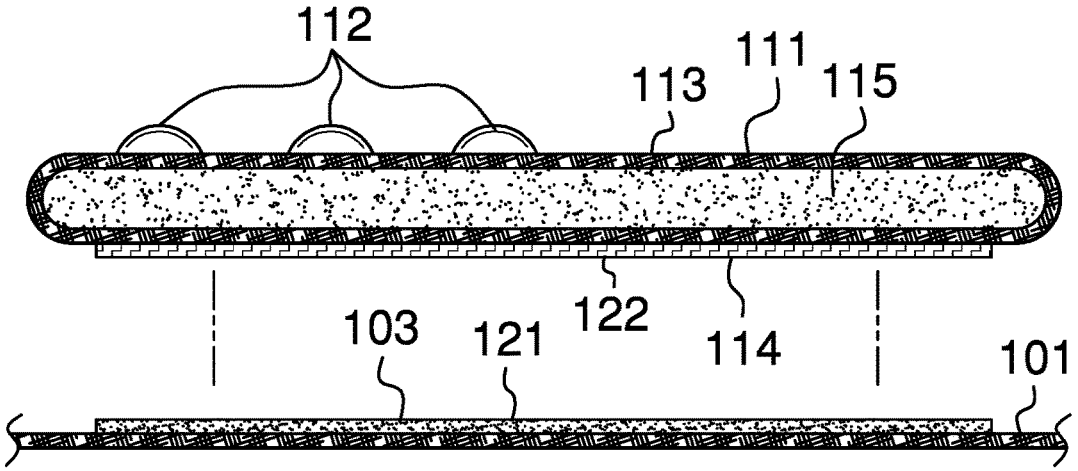
FIG. 4 is a cross-sectional view of an embodiment of the disclosure across line 4-4 in FIG. 3.
Figure 3:
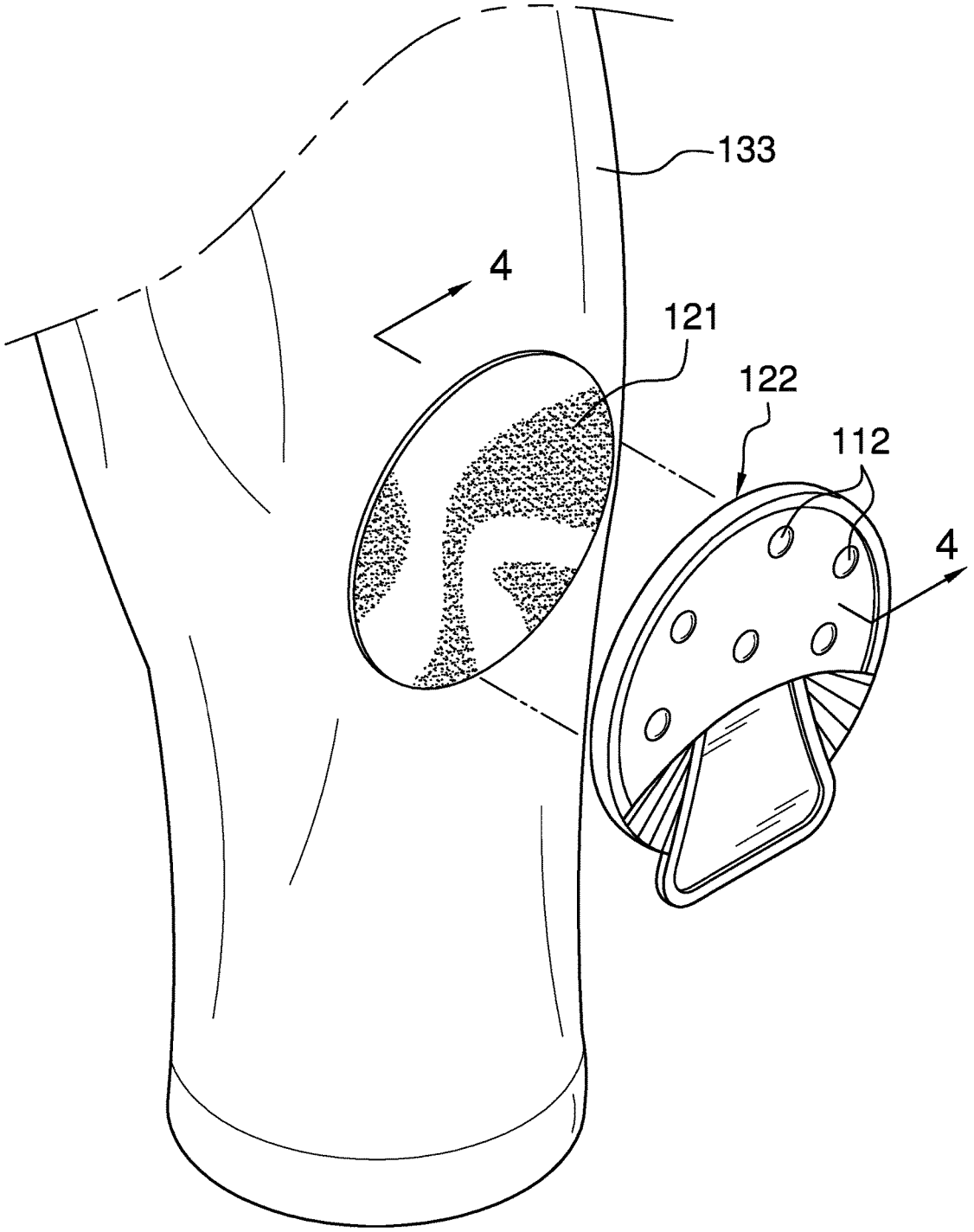
FIG. 3 is an exploded view of an embodiment of the disclosure.
Figure 5:
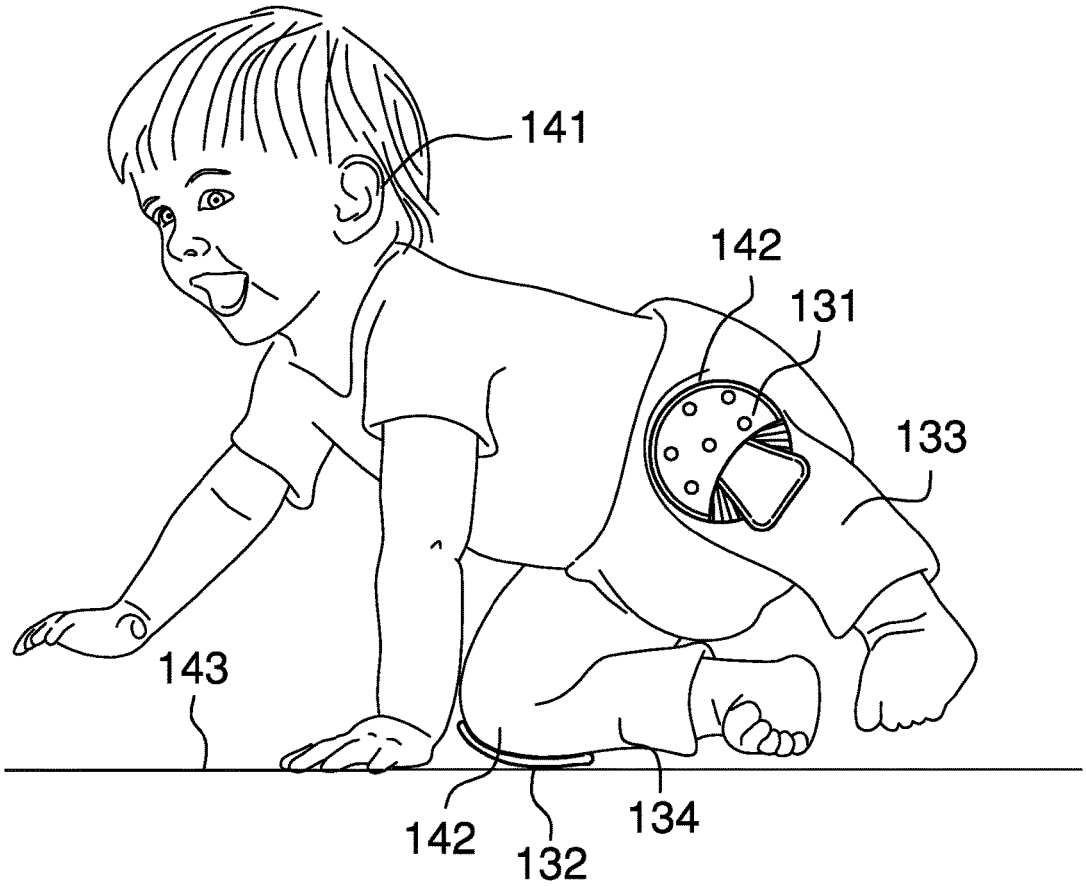
FIG. 5 is an in use view of an embodiment of the disclosure.

Detailed reference will now be made to a first potential embodiment of the disclosure, which is illustrated in FIGS. 1 through 5.

The baby garment with multiple interchangeable themed knee pads 100 (hereinafter invention) comprises a pair of pants 101, a plurality of knee pads 102, and a plurality of hook and loop fasteners 103. The invention 100 is adapted for infants 141 who are beginning to crawl (6 to 12 months age). A first knee pad 131 and a second knee pad 132 selected from the plurality of knee pads 102 are attached to the pair of pants 101 such that the knee pads rest between the knee 142 of the infant 141 and the surface 143 upon which the infant 141 is crawling.

The pair of pants 101 is a commercially available full length pants for infants 141.

Each of the plurality of knee pads 102 comprises a protective shell 111, one or more non-skid grips 112, and padding 115. The protective shell 111 is made from a heavy textile, such a ballistic nylon or canvas, or a flexible plastic plate. The protective shell 111 further comprises a first surface 113 and a second surface 114. The first surface 113 is the surface of the protective shell 111 that is distal from the fabric of the pair of pants 101. The second surface 114 is the surface that is distal from the first surface 113. The protective shell 111 incorporates a padding 115. The padding 115 is a soft material that is attached to the first surface 113 that protects the infant's 141 knees 142 from damage from the surface 143. Each of the one or more non-skid grips 112 is a soft or tacky material that is attached to the first surface 113. Each of the one or more non-skid grips 112 gives the infant 141 purchase on the surface 143 the infant 141 is crawling on. Each of the one or more non-skid grips 112 also prevents the infant 141 from sliding or skidding while crawling on the surface 143.

The hook and loop fastener 103 attaches each of the plurality of knee pads 102 to the pair of pants 101. The hook and loop fastener 103 further comprises a first hook or loop surface 121, a second hook or loop surface 122, a third hook or loop surface 123, and a fourth hook or loop surface 124. The first hook or loop surface 121 is attached to the knee 142 region of the left pant leg 133. The third hook or loop surface 123 is attached to the knee 142 region of the right pant leg 134. The second hook or loop surface 122 is attached to the first knee pad 131. The fourth hook or loop surface 124 is attached to the second knee pad 132. To attach the first knee pad 131 to the left pant leg 133, the third hook or loop surface 123 is pressed against the first hook or loop surface 121. To attach the second knee pad 132 to the right pant leg 134, the fourth hook or loop surface 124 is pressed against the second hook or loop surface 122.

In the first potential embodiment of the disclosure, the plurality of knee pads 102 are envisioned to contain four or more knee 142 pads, including the first knee pad 131 and the second knee pad 132. Furthermore it is envisioned that each of the knee pads selected from the plurality of knee pads 102 is "paired" with a matching knee pad that has the identical form and decoration as the selected knee pad wherein the "paired" knee pads form a "theme." The differences between each "pair" of matching knee 142 pads encompasses differences in the decoration, the shape, and the form of the knee pads. This allows a parent to replace the first knee pad 131 and the second knee pad 132 with differing "themes" as desired.

The second potential embodiment of the disclosure is identical to the first potential embodiment of the disclosure except that the padding 115 was excluded from the plurality of knee pads 102.

The first hook or loop surface 121 and the third hook or loop surface 123 can be sewn or glued to the pair of pants 101. The second hook or loop surface 122 and the fourth hook or loop surface 124 can be sewn or glued to the protective shell 111. The padding 115 can be sewn or glued to the protective shell 111. Each of the one or more non-skid grips 112 can be sewn of glued to the padding 115 or the protective shell 111 as is appropriate.

The following definitions were used in this disclosure:

Fastener: As used in this disclosure, a fastener is a device that is used to join or affix two objects. Fasteners generally comprise a first part, which is attached to the first object and a second part which is attached to the second object.

Hook and Loop Fastener: As used in this disclosure, a hook and loop fastener is a fastener that comprises a hook surface and a loop surface. The hook surface comprises a plurality of minute hooks. The loop surface comprises a surface of uncut pile that acts like a plurality of loops. When the hook surface is applied to the loop surface, the plurality of minute hooks fasten to the plurality of loops securely fastening the hook surface to the loop surface. A note on usage: when fastening a two objects the hook surface of a hook and loop fastener will be placed on the first object and the matching loop surface of a hook and loop fastener will be placed on the second object without significant regard to which object of the two objects is the first object and which of the two objects is the second object. When the hook surface of a hook or loop fastener or the loop surface of a hook and loop fastener is attached to an object this will simply be referred to as the "hook or loop surface" with the understanding that when the two objects are fastened together one of the two objects will have a hook surface and the remaining object will have the loop surface.

Padding: As used in this disclosure, a padding is a mass of soft material used as a filling or for protection against damage or injury.

Textile: As used in this disclosure, a textile is a material that is woven, knitted, or felted. Synonyms in common usage for this definition include fabric and cloth.

With respect to the above description, it is to be realized that the optimum dimensional relationship for the various components of the invention described above and in FIGS. 1 through 5, include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A garment comprising:

a pair of pants, a plurality of knee pads, and a plurality of hook and loop fasteners;

wherein the garment is adapted for use by an infant;

wherein the plurality of knee pads comprises a plurality of knee pad pairs;

wherein each of the plurality of knee pad pairs forms a theme;

wherein any first selected knee pad selected from the plurality of knee pads is interchangeable with any second selected knee pad selected from the plurality of knee pads;

wherein a first knee pad and a second knee pad selected from the plurality of knee pads are attached to the pair of pants;

wherein a first knee pad and a second knee pad selected from the plurality of knee pads are positioned such that the knee pads rest between the knee of the infant and the surface upon which the infant is crawling;

wherein the pair of pants is full length pants;

wherein the protective shell is made material selected from the group consisting of ballistic nylon, canvas, or a flexible plastic plate;

wherein the protective shell incorporates a padding;

wherein each of the one or more non-skid grips is a soft or tacky material.

2. The garment according to claim 1 wherein each of the plurality of knee pads comprises a protective shell, one or more non-skid grips, and padding.

3. The garment according to claim 1 wherein each of the one or more non-skid grips is attached to the protective shell.

4. The garment according to claim 3 wherein the hook and loop fastener attaches each of the plurality of knee pads to the pair of pants.

5. The garment according to claim 4 wherein the hook and loop fastener further comprises a first hook or loop surface, a second hook or loop surface, a third hook or loop surface, and a fourth hook or loop surface.

6. The garment according to claim 5 wherein the first hook or loop surface is attached to the knee region of the left pant leg.

7. The garment according to claim 6 wherein the third hook or loop surface is attached to the knee region of the right pant leg.

8. The garment according to claim 7 wherein the second hook or loop surface is attached to a first knee pad selected from the plurality of knee pads that is applied to the pair of pants.

9. The garment according to claim 8 wherein the fourth hook or loop surface is attached to a second knee pad selected from the plurality of knee pads that is applied to the pair of pants.

10. The garment according to claim 9 wherein the second hook or loop surface is attached to the first hook or loop surface.

11. The garment according to claim 10 wherein the fourth hook or loop surface is attached to the third hook or loop surface.

* * * * *